US007190240B2

(12) United States Patent
Podell

(10) Patent No.: US 7,190,240 B2
(45) Date of Patent: Mar. 13, 2007

(54) MULTI-SECTION COUPLER ASSEMBLY

(75) Inventor: Allen F. Podell, Palo Alto, CA (US)

(73) Assignee: Werlatone, Inc., Brewster, NY (US)

( * ) Notice: Subject to any disclaimer, the term of this patent is extended or adjusted under 35 U.S.C. 154(b) by 0 days.

(21) Appl. No.: 11/282,197

(22) Filed: Nov. 17, 2005

(65) Prior Publication Data

US 2006/0066418 A1 Mar. 30, 2006

Related U.S. Application Data

(63) Continuation-in-part of application No. 10/607,189, filed on Jun. 25, 2003, now Pat. No. 7,132,906.

(51) Int. Cl.
*H01P 5/12* (2006.01)

(52) U.S. Cl. ..... 333/109; 333/117

(58) Field of Classification Search ..... 333/109, 333/116, 117

See application file for complete search history.

(56) References Cited

U.S. PATENT DOCUMENTS 3,184,691 A 5/1965 Marcatili et al.
3,345,585 A 10/1967 Hildebrand
3,514,722 A 5/1970 Cappucci
3,516,024 A 6/1970 Lange
3,737,810 A * 6/1973 Shelton ..... 333/116
3,748,601 A 7/1973 Seidel
3,904,991 A 9/1975 Ishii et al.
3,967,220 A 6/1976 Tagashira et al.
3,999,150 A 12/1976 Caragliano et al.
4,158,184 A 6/1979 Kenyon
4,216,446 A 8/1980 Iwer
4,305,043 A * 12/1981 Ho et al. ..... 330/53
4,443,772 A 4/1984 Schwarzmann
4,482,873 A 11/1984 Nyhus
4,777,458 A 10/1988 Pardini
4,800,345 A 1/1989 Podell et al.
4,937,541 A 6/1990 Podell et al.
4,999,593 A 3/1991 Anderson (Continued)

OTHER PUBLICATIONS

"*M/A COM Application Note: RF Directional Couplers and 3dB Hybrids Overview*", No author listed, Publication of AMP Incorporated, pp. 10-5 to 10-14, undated, downloaded from www.macom.com Apr. 14, 2005.

(Continued)

*Primary Examiner*—Don P. Le
(74) *Attorney, Agent, or Firm*—Kolisch Hartwell, P.C.

(57) ABSTRACT

A coupler assembly may include first and second electromagnetic couplers connected together. In some examples, the couplers may be connected in cascade configuration, with at least the second coupler including at least third and fourth couplers connected in tandem configuration. In some examples, a first asymmetric coupler may include a plurality of coupler sections connected in cascade configuration, and a second coupler connected to the first coupler in tandem configuration. In some examples, a direct port of a first coupler section may be conductively connected through a second coupler section to an isolated port of the first coupler section. In some examples, a coupler assembly may include first and second transmission lines having respective conductors electromagnetically coupled in a plurality of serially connected coupler sections, which sections have coupled portions with substantially the same cross-sectional configuration and lengths that are progressively longer or shorter in successive coupled portions.

11 Claims, 6 Drawing Sheets

U.S. PATENT DOCUMENTS 5,187,447 A * 2/1993 Tsai ..... 330/124 R
5,369,379 A 11/1994 Fujiki
5,428,839 A 6/1995 Friesen et al.
5,557,245 A 9/1996 Taketa et al.
5,563,558 A 10/1996 Mohwinkel et al.
5,576,671 A 11/1996 Agar et al.
5,634,208 A 5/1997 Nishikawa et al.
5,689,217 A 11/1997 Gu et al.
5,742,210 A 4/1998 Chaturvedi et al.
5,757,241 A 5/1998 Simonutti
5,793,272 A 8/1998 Burghartz et al.
5,815,803 A 9/1998 Ho et al.
5,841,328 A 11/1998 Hayashi
5,852,866 A 12/1998 Kuettner et al.
5,889,444 A 3/1999 Johnson et al.
5,926,076 A 7/1999 Johnson et al.
5,982,252 A 11/1999 Werlau
6,020,783 A 2/2000 Coppola
6,246,299 B1 6/2001 Werlau
6,265,937 B1 * 7/2001 Mohwinkel et al. ..... 330/55
6,342,681 B1 1/2002 Goldberger et al.
6,346,863 B2 2/2002 Sasaki et al.
6,374,017 B1 4/2002 Romaniuk
6,407,647 B1 6/2002 Apel et al.
6,407,648 B1 6/2002 Johnson
6,483,397 B2 11/2002 Catoiu
6,515,556 B1 2/2003 Kato et al.
6,518,856 B1 2/2003 Casale et al.
6,522,222 B1 2/2003 Pchelnikov et al.
6,580,334 B2 6/2003 Simburger et al.
6,636,126 B1 * 10/2003 Pozdeev ..... 333/117
6,642,809 B2 11/2003 Shin et al.
6,686,812 B2 2/2004 Gilbert et al.
6,738,611 B1 * 5/2004 Politi ..... 455/302
6,747,525 B2 6/2004 Iida et al.
6,756,860 B2 6/2004 Shin
6,759,918 B2 7/2004 du Toit et al.
6,765,455 B1 7/2004 De Lillo et al.
6,771,141 B2 8/2004 Iida
6,806,558 B2 10/2004 Apel
2004/0263281 A1 12/2004 Podell

OTHER PUBLICATIONS

An, Hongming et. al, *IA 50:1 Bandwidth Cost-Effective Coupler with Sliced Coaxial Cable*, IEEE MTT-S Digest, pp. 789-792, Jun. 1996.

Walker, J.L.B., *Analysis and Design of Kemp-Type 3 dB Quadrature Couplers*, IEEE Transactions on Microwave Theory and Techniques, vol. 38, No. 1, pp. 88-90, Jan. 1990.

Bickford, Joel D. et. al, *Ultra-Broadband High-Directivity Directional Coupler Design*, IEEE MTT-S Digest, pp. 595-598, 1988.

Howe, Harlan Jr., *Stripline Circuit Design*, Artech House, Inc., pp. 169-170, 1977.

Shelton, J.P. and Mosko, J.A., *Synthesis and Design of Wide-Band Equal-Ripple TEM Directional Couplers and Fixed Phase Shifters*, IEEE Transactions on Microwave Theory and Techniques, vol. MTT-14, No. 10, pp. 462-473, 1966, no month.

Young, Leo, *The analytical equivalence of TEM-mode directional couplers and transmission-line stepped-impedance filters*, Proceedings IEEE, vol. 110, No. 2, pp. 275-281, Feb. 1963.

Levy, Ralph, *General Synthesis of Asymmetric Multi-Element Coupled-Transmission-Line Directional Couplers*, * IEEE Transactions on Microwave Theory and Techniques, vol. MTT-11, No. 4, pp. 226-237, Jul. 1963.

Monteath, G.D., *Coupled Transmission Lines as Symmetrical Directional Couplers*, Proc. IEE, vol. 102, Part B, No. 3, pp. 383-392, May 1955.

Oliver, Bernard M., *Directional Electromagnetic Coupler*, * Proc. IRE, vol. 42, No. 11, pp. 1686-1692, Nov. 1954.

Gerst, C.W., *11-7 Electrically Short 90+ Couplers Utilizing Lumped Capacitors*, Syracuse University Research Corporation, pp. 58-62, year unknown.

* cited by examiner

MULTI-SECTION COUPLER ASSEMBLY

RELATED APPLICATIONS

This is a continuation-in-part of application Ser. No. 10/607,189, filed Jun. 25, 2003, now U.S. Pat. No. 7,132, 906, published as Publication Number US-2004-0263281-A1 on Dec. 30, 2004, which application is incorporated herein by reference in its entirety for all purposes.

BACKGROUND OF THE DISCLOSURE

The present disclosure relates to electromagnetic couplers, and in particular to such couplers formed as a combination of coupler sections.

A pair of conductive lines are coupled when they are spaced apart, but spaced closely enough together for energy flowing in one to be electromagnetically and electrostatically induced in the other. The amount of energy flowing between the lines is related to the dielectric and magnetic media the conductors are in and the spacing between the lines. Even though electromagnetic fields surrounding the lines are theoretically infinite, lines are often referred to as being closely or tightly coupled, loosely coupled, or uncoupled, based on the relative amount of coupling.

Couplers are devices formed to take advantage of coupled lines, and may have four ports, one for each end of two coupled lines. A main line has an input connected directly or indirectly to an input port. The other end is connected to the direct port. The other or auxiliary line extends between a coupled port and an isolated port. One or more of the ports may be terminated to form a coupler device having fewer than four ports. Some couplers are described as having two input ports, a sum port that has a signal that is the sum of signals received at the input ports, and a difference port that has a signal that is the difference of the signals received at the input ports. A coupler may be reversed, in which case the isolated port becomes the input port and the input port becomes the isolated port. Correspondingly, the coupled port and direct port then have reversed designations.

Directional couplers are four-port networks that may be simultaneously impedance matched at all ports. Power may flow from one or the other input port to the pair of output ports, and if the output ports are properly terminated, the ports of the input pair are isolated. A hybrid coupler is generally assumed to divide its output power equally between the two outputs, whereas a directional coupler, as a more general term, may have unequal outputs. Often, the coupler has very weak coupling to the coupled output, which minimizes the insertion loss from the input to the main output. One measure of the quality of a directional coupler is its directivity, the ratio of the desired coupled output to the isolated port output.

Adjacent parallel transmission lines couple both electrically and magnetically. The coupling is inherently proportional to frequency, and the directivity can be high if the magnetic and electric couplings are equal. Longer coupling regions increase the coupling between lines, until the vector sum of the incremental couplings no longer increases, and the coupling will decrease with increasing electrical length in a sinusoidal fashion. In many applications it is desired to have a constant coupling over a wide band. Symmetrical couplers exhibit inherently a 90-degree phase difference between the coupled output ports, whereas asymmetrical couplers have phase differences that approach zero-degrees or 180-degrees.

Unless ferrite or other high permeability materials are used, greater than octave bandwidths at higher frequencies are generally achieved through cascading couplers. In a uniform long coupler the coupling rolls off when the length exceeds one-quarter wavelength, and only an octave bandwidth is practical for +/−0.3 dB coupling ripple. If three equal length couplers are connected as one long coupler, with the two outer sections being equal in coupling and much weaker than the center coupling, a wideband design results. At low frequencies, the coupling of all three couplers add. At higher frequencies, the three sections can combine to give reduced coupling at the center frequency, where each coupler is one-quarter wavelength. This design may be extended to many sections to obtain a very large bandwidth.

Two conditions come from the cascaded coupler approach. One is that the coupler becomes very long and lossy, since its combined length is more than one-quarter wavelength long at the lowest band edge. Further, the coupling of the center section gets very tight, especially for 3 dB multi-octave couplers. A cascaded coupler of X:1 bandwidth is about X quarter wavelengths long at the high end of its range. As an alternative, the use of lumped, but generally higher loss, elements have been proposed.

An asymmetrical coupler with a continuously increasing coupling that abruptly terminates at the end of the coupled region will behave differently from a symmetrical coupler. Instead of a constant 90-degree phase difference between the output ports, close to zero or 180 degrees phase difference can be realized. If only the magnitude of the coupling is important, this coupler can be shorter than a symmetric coupler for a given bandwidth, perhaps two-thirds or three-fourths the length.

These couplers, other than lumped element versions, are designed using an analogy between stepped impedance couplers and transformers. As a result, the couplers are made in stepped sections that each have a length of one-fourth wavelength of a center design frequency, and are typically several sections long. The coupler sections may be combined into a smoothly varying coupler. This design theoretically raises the high frequency cutoff, but it does not reduce the length of the coupler.

BRIEF SUMMARY OF THE DISCLOSURE

A coupler assembly may include first and second electromagnetic couplers connected together. In some examples, the couplers may be connected in cascade configuration, with at least the second coupler including at least third and fourth couplers connected in tandem configuration. In some examples, a first asymmetric coupler may include a plurality of coupler sections connected in cascade configuration, and a second coupler connected to the first coupler in tandem configuration. In some examples, a direct port of a first coupler section may be conductively connected through a second coupler section to an isolated port of the first coupler section. In some examples, a coupler assembly may include first and second transmission lines having respective conductors electromagnetically coupled in a plurality of serially connected coupler sections, which sections have coupled portions with substantially the same cross-sectional configuration and lengths that are progressively longer or shorter in successive coupled portions.

DETAILED DESCRIPTION OF VARIOUS EXAMPLES

This description is illustrative and directed to the apparatus and/or method(s) described, and is not limited to any specific invention or inventions. The claims that are appended to this description define specific inventions contained in one or more of the disclosed examples, whether the claims are presented at the time of filing or later in this or a subsequent application. No single feature or element, or combination thereof, is essential to all possible combinations that may now or later be claimed. All inventions may not be included in every example. Many variations may be made to the disclosed embodiments. Such variations, whether they are directed to different combinations or directed to the same combinations, whether different, broader, narrower or equal in scope, are also regarded as included within the subject matter of the present disclosure.

Where "a" or "a first" element or the equivalent thereof is recited, such usage includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically indicated.

As used in this document, the terms coupler, coupler assembly and coupler section may be interchangeable, depending upon the configuration of the apparatus involved. For example, a coupler may be a stand-alone device or part of a stand-alone device that may be referred to as a coupler assembly. Also, a coupler, a coupler assembly and a coupler section may all be components of a stand-alone device. A basic coupler building block, and may include coupled portions, with or without uncoupled portions of conductors. A pair of conductor portions forming a basic coupler section may be an integral number of quarter wavelengths of a design frequency. Conductor portions forming coupler sections may include coupled portions and uncoupled portions. For reduced length, conductor portions may be one-fourth of a wavelength of a design frequency. Further, unless otherwise indicated, the terms coupler assembly, coupler, coupler section, coupled portion and uncoupled portion refer to electromagnetic coupling.

Figure 1:
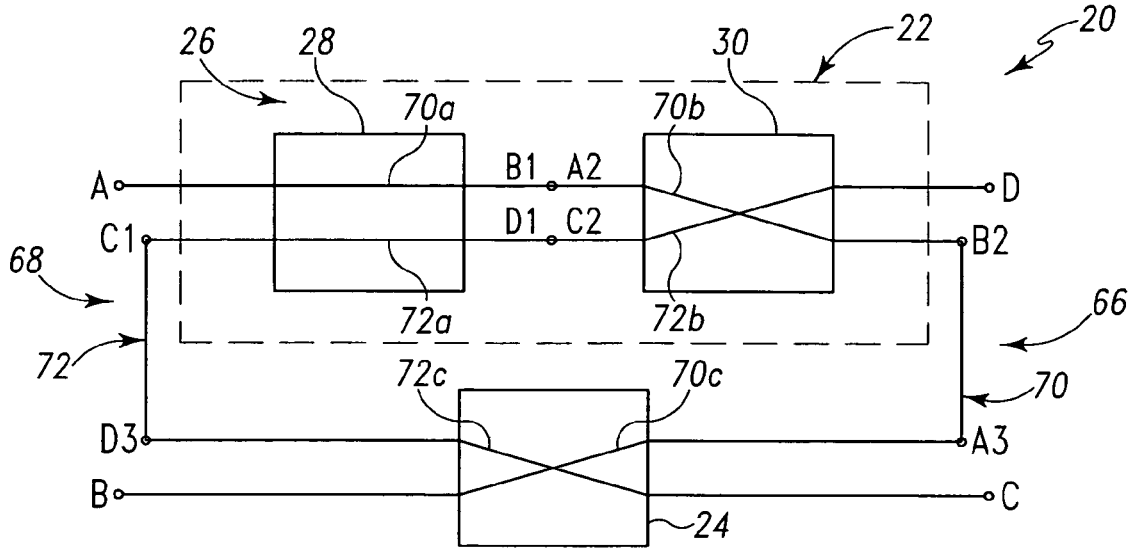
FIG. 1 is a diagram of a multi-section coupler assembly.

Referring to FIG. 1, an example of a coupler assembly, shown generally at 20, may include a first coupler 22 and a second coupler 24. First coupler 22 may be asymmetric and include a plurality of coupler sections 26, such as coupler sections 28 and 30 connected in cascade configuration. Any of coupler 22 and coupler sections 26 may include only one coupler section or a plurality of further coupler sections. Second coupler 24 may be connected to the first coupler in tandem configuration. Examples of couplers connected in cascade and tandem are illustrated in FIGS. 2 and 3.

Figure 2:
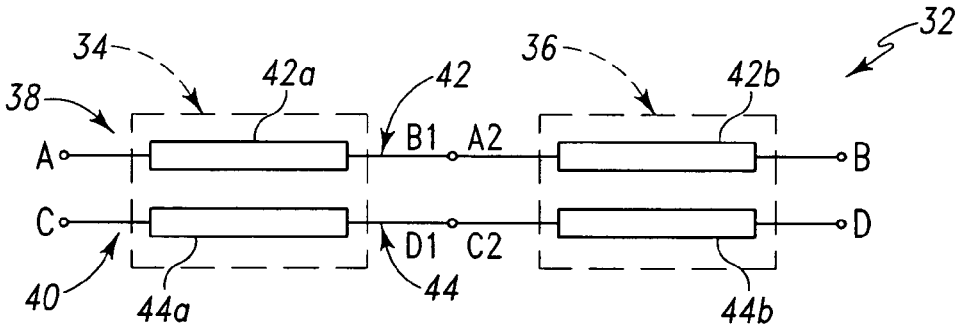
FIG. 2 is a diagram of a coupler assembly formed of two couplers connected in cascade.
Figure 3:
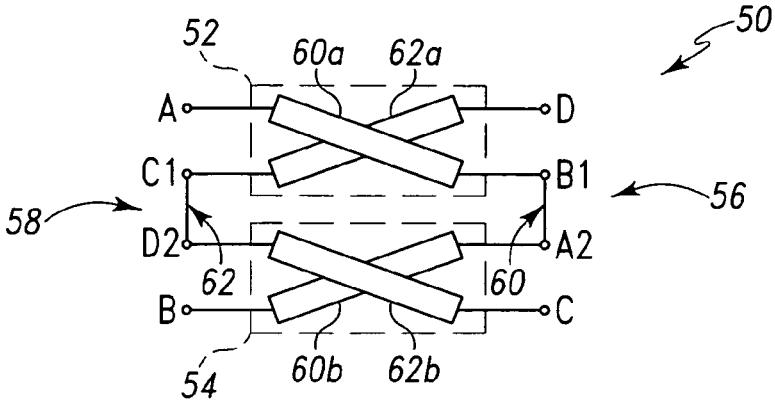
FIG. 3 is a diagram of a coupler assembly formed to two couplers connected in tandem.

FIG. 2 illustrates an example of a coupler 32 having two coupler sections 34 and 36 connected in cascade configuration. Coupler 32 may include first and second transmission lines 38 and 40 including, respectively, conductors 42 and 44. Conductors 42 and 44 have respective coupled portions 42*a* and 44*a* in coupler section 34, and coupled portions 42*b* and 44*b* in coupler section 36.

Each coupler assembly, coupler or coupler section may be considered to have input ports A and D and output ports B and C, with the understanding that this also includes the reverse arrangement in which ports B and C are the input ports and ports A and D are the output ports. Ports A and B are conductively connected on one conductor and ports C and D are conductively connected on the other conductor. Port C may be coupled to port A, and port D may be isolated from port A. Correspondingly, port A may be isolated from port D, and port B may be coupled to port D.

Referring to FIG. 2, coupler 32 has input ports A and D, and output ports B and C. Input port A of conductor 42 is conductively connected to an output port B of conductor 42 via coupler sections 34 and 36. An output port B1 of coupler section 34 is conductively connected to an input port A2 of coupler section 36. Similarly, input port D is conductively connected to output port C via coupler sections 36 and 34. An output port C2 of coupler section 36 is conductively connected to an input port D1 of coupler section 34.

FIG. 3 illustrates an example of a coupler 50 having two coupler sections 52 and 54 connected in tandem configuration. Coupler 50 may include first and second transmission lines 56 and 58 including, respectively, conductors 60 and 62. Coupler 50 has ports A, B, C, D; coupler section 52 has ports A, B1, C1, D; and coupler section 54 has ports A2, B, C, D2. Coupler section 52 includes coupled conductor portions 60*a* and 62*a*; and coupler section 54 includes coupled conductor portions 60*b* and 62*b*.

It is seen that port A is conductively coupled to port B and port C is conductively coupled to port D. As in the cascade configuration illustrated in FIG. 2, port B1 of coupler section 52 is conductively connected to port A2 of coupler section 54. However, coupled port C1 of coupler section 52 is conductively connected to uncoupled port D2 of coupler section 54.

Referring again to FIG. 1, coupler assembly 20 further may include transmission lines 66 and 68 having respective conductors 70 and 72. Conductors 70 and 72 have coupled portions 70*a* and 72*a* forming coupler section 28, coupled portions 70*b* and 72*b* forming coupler section 30, and coupled portions 70*c* and 72*c* forming coupler section 24.

As mentioned, coupler sections 28 and 30 are coupled in cascade to form coupler 22. Coupler 22 includes ports A, B2, C1, D. Coupler 24 includes ports A3, B, C, D3. Port B2 is conductively connected to port A3 and port C1 is conductively connected to port D3. Hence, couplers 22 and 24 are connected together in tandem configuration to form coupler assembly 20 having ports A, B, C, D.

Figure 4:
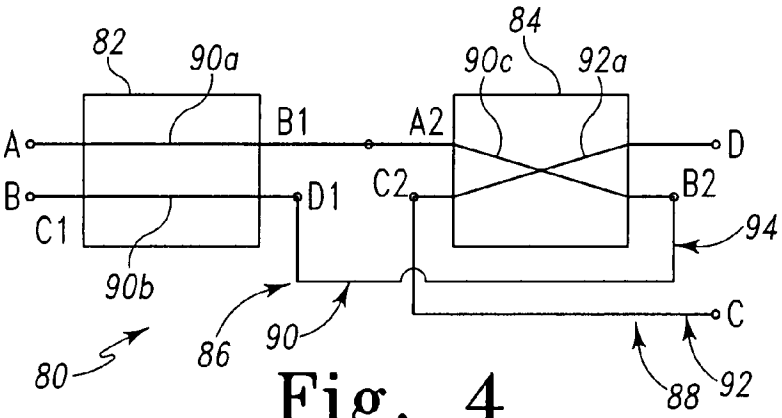
FIG. 4 is a diagram of another multi-section coupler assembly.

FIG. 4 illustrates another example of a coupler assembly, shown generally at 80, that includes couplers 82 and 84. Coupler 80 also includes transmission lines 86 and 88 having respective conductors 90 and 92. Either or both of couplers 82 and 84 may include only one section of coupled conductor portions or a plurality of coupled conductor portions. Coupler assembly 80 includes ports A, B, C, D; coupler 82 includes ports A, B1, C1, D1; and coupler 84 includes ports A2, B2, C2, D.

The transmission-line conductors have portions that are coupled to form the respective couplers. Specifically, coupler 82 may be formed by coupled conductor portions 90*a* and 90*b*, making coupler 82 what may be referred to as a self-coupled coupler. Coupler 84 may be formed by coupled conductor portions 90*c* and 92*a*. Correspondingly, couplers 82 and 84 may be coupled in a modified cascade configuration, which may also be referred to as a return-loop configuration since one conductor forms a loop 94 that begins and ends at the same coupler. It is seen that conductor portion 90*c* of coupler 84 is between portions 90*a* and 90*b* of coupler 82. Further, port A is conductively connected to port B via both couplers 82 and 84. That is, the direct port of coupler 82 is conductively connected to the isolated port of coupler 82 via coupler 84. This results in the input and coupled ports of coupler 82 being conductively connected via coupler 84.

Figure 5:
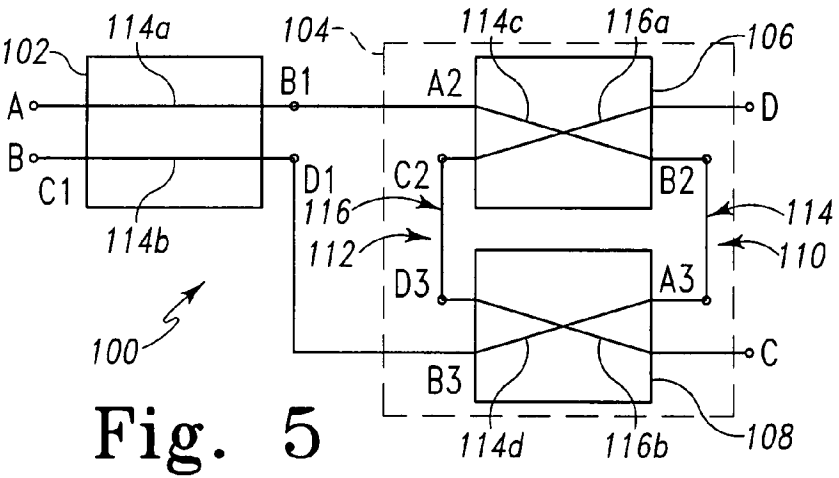
FIG. 5 is a diagram of a multi-section coupler assembly made according to the coupler assembly of FIG. 4.

FIG. 5 illustrates a further example of a coupler assembly, shown generally at 100, that may be a modified combination of couplers 20 and 32. Coupler assembly 100 includes couplers 102 and 104. Coupler 104 may include coupler sections 106 and 108. Coupler assembly 100 may have ports A, B, C, D. Coupler 102 may have ports A, B1, C1, D1. Coupler 104 may have ports A2, B3, C, and D. Coupler section 106 may have ports A2, B2, C2 and D. Coupler section 108 may have ports A3, B3, C and D3.

Coupler assembly 100 may be formed of first and second transmission lines 110 and 112 having respective conductors 114 and 116. Coupler 102 may be formed by coupled portions 114*a* and 114*b* of conductor 114. Coupler 106 may be formed by coupled portion 114*c* of conductor 114 and portion 116*a* of conductor 116. Also, coupler 108 may be formed by conductor portions 114*d* and 116*b*, as shown.

It is seen that couplers 102 and 104 are shown generally in a modified cascade or return-loop configuration, similar to couplers 82 and 84 of coupler assembly 80. Further, coupler sections 106 and 108 may be coupled together in a tandem configuration, similar to coupler sections 52 and 54 of coupler 50.

Figure 6:
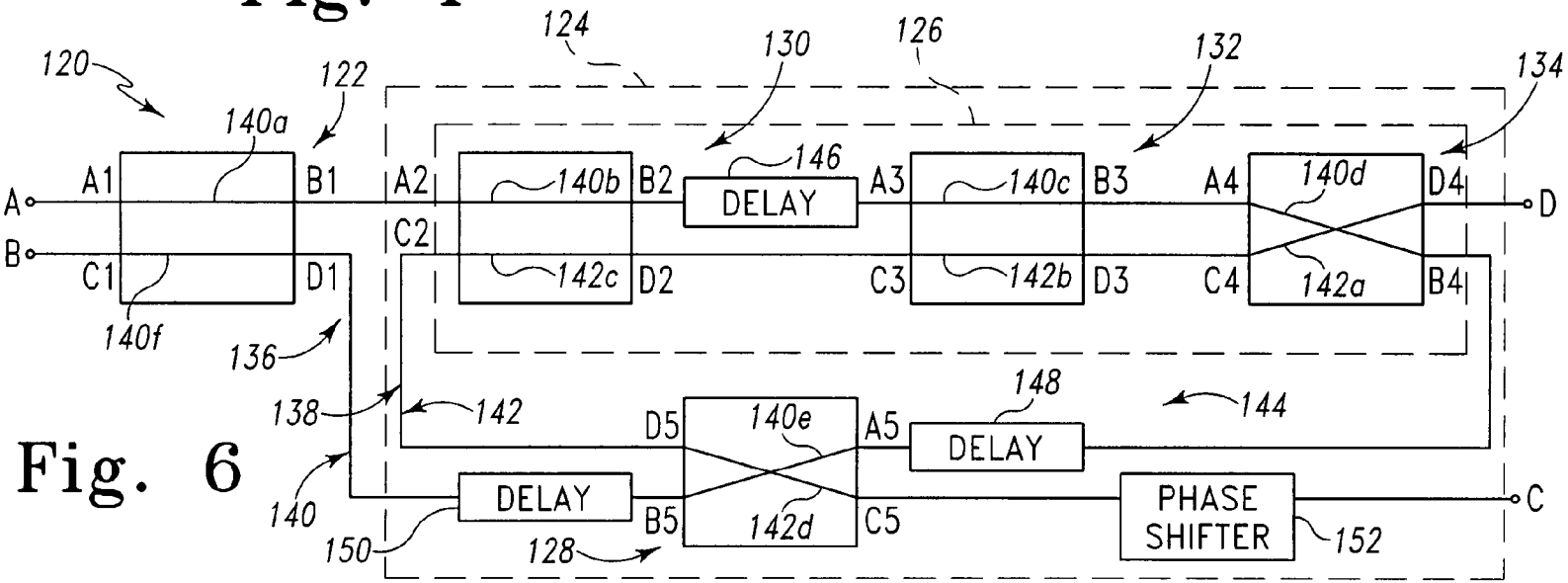
FIG. 6 is a diagram of yet another multi-section coupler assembly that may be an example of the coupler assembly of FIG. 1, FIG. 4 or FIG. 5.

Referring now to FIG. 6, an example of a more complex coupler assembly is shown generally at 120. Coupler assembly 120 may include couplers 122 and 124 coupled in a modified cascade or return-loop configuration, similar to coupler assembly 80 shown in FIG. 4 or coupler assembly 100 shown in FIG. 5. Coupler 124 may include couplers 126 and 128 connected in tandem, similar to coupler assemblies 20 and 50 shown in FIGS. 1 and 3, respectively. Further, coupler 126 may include a plurality of coupler sections, such as coupler sections 130, 132 and 134 connected in cascade configuration, similar to the configuration shown in FIG. 2.

In this example, coupler assembly 120 has ports A, B, C, D. Coupler 122 has ports A1, B1, C1, D1. Coupler 124 has ports A2, B5, C (C5), D (D4). Coupler 126 has ports A2, B4, C2, D (D4). Coupler 128 has ports A5, B5, C5, D5. Coupler section 130 has ports A2, B2, C2, D2. Coupler section 132 has ports A3, B3, C3, D3. Coupler section 134 has ports A4, B4, C4, D4.

Coupler assembly 120, as shown, is further formed of first and second transmission lines 136 and 138 including respective conductors 140 and 142. Conductor 140 includes the serial configuration of conductor portions 140*a*, 140*b*, 140*c*, 140*d*, 140*e* and 140*f*. Conductor 142 includes the serial configuration of conductor portions 142*a*, 142*b*, 142*c* and 142*d*. Coupler 122 is formed by coupled conductor portions 140*a* and 140*f*. Coupler 128 is formed by coupled portions 140*e* and 142*d*. Coupler section 130 is formed by coupled portions 140*b* and 142*c*. Coupler section 132 is formed by coupled portions 140*c* and 142*b*. Finally, coupler section 134 is formed by coupled portions 140*d* and 142*a*.

In this example three delay devices 144 are included in transmission line 140. A first delay device 146 is disposed between coupler section ports B2 and A3. A second delay device 148 is disposed between coupler section port B4 and coupler port A5. A third delay device 150 is disposed between coupler ports B5 and D1. Additionally, there may be a phase shifter 152 coupling port C5 to the coupler assembly output port C, as shown. The delay devices 146 and phase shifter 152 may provide for adjustment of the relative phases of signals at output ports B and C. Further, the delay devices may also be included in adjacent couplers or coupler sections, as is shown in the example depicted in FIGS. 7–10.

Figure 7:
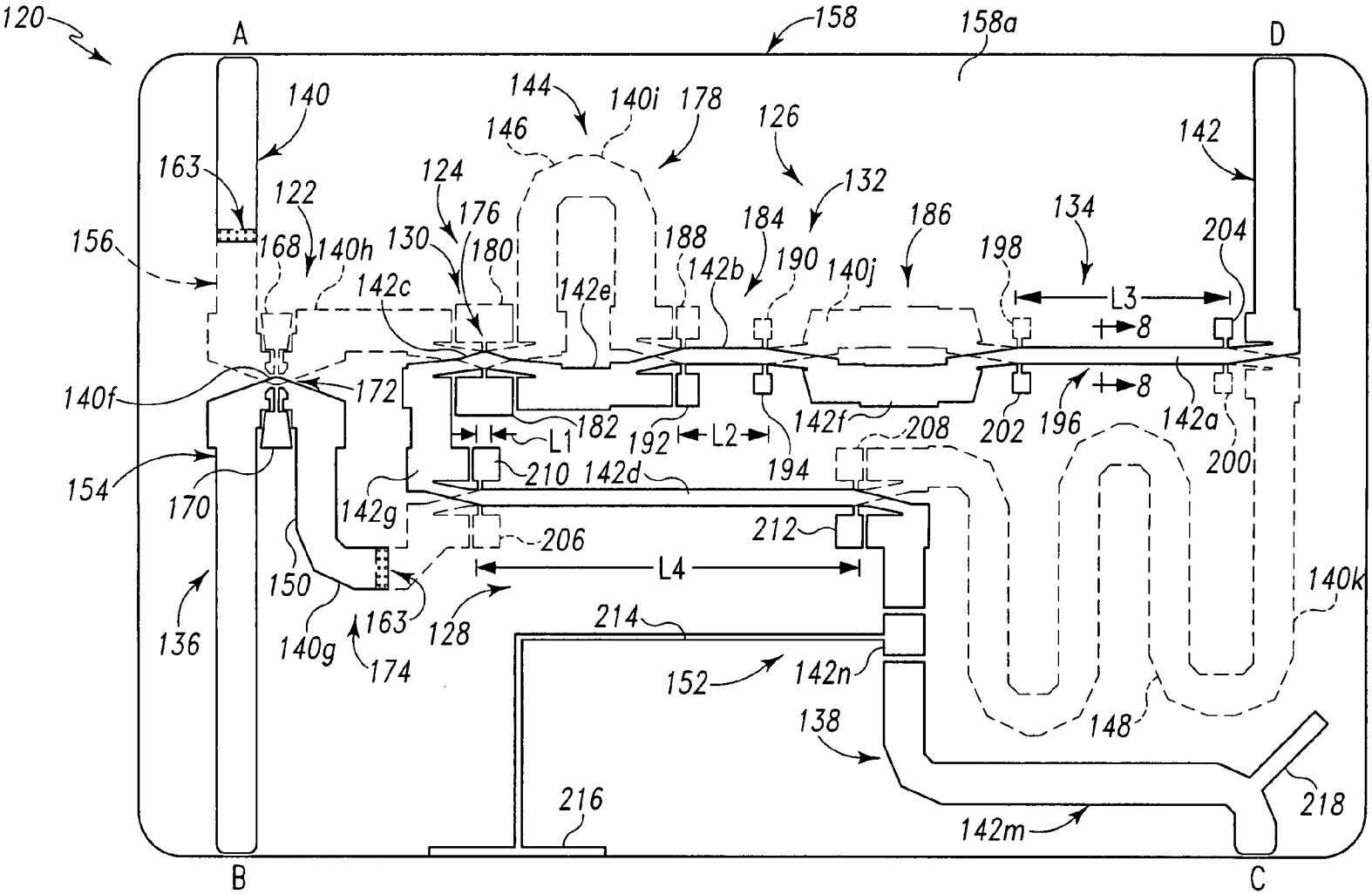
FIG. 7 is a top view of an example of the multi-section coupler assembly of FIG. 6 formed using two layers of metallization separated by a dielectric layer.
Figure 8:
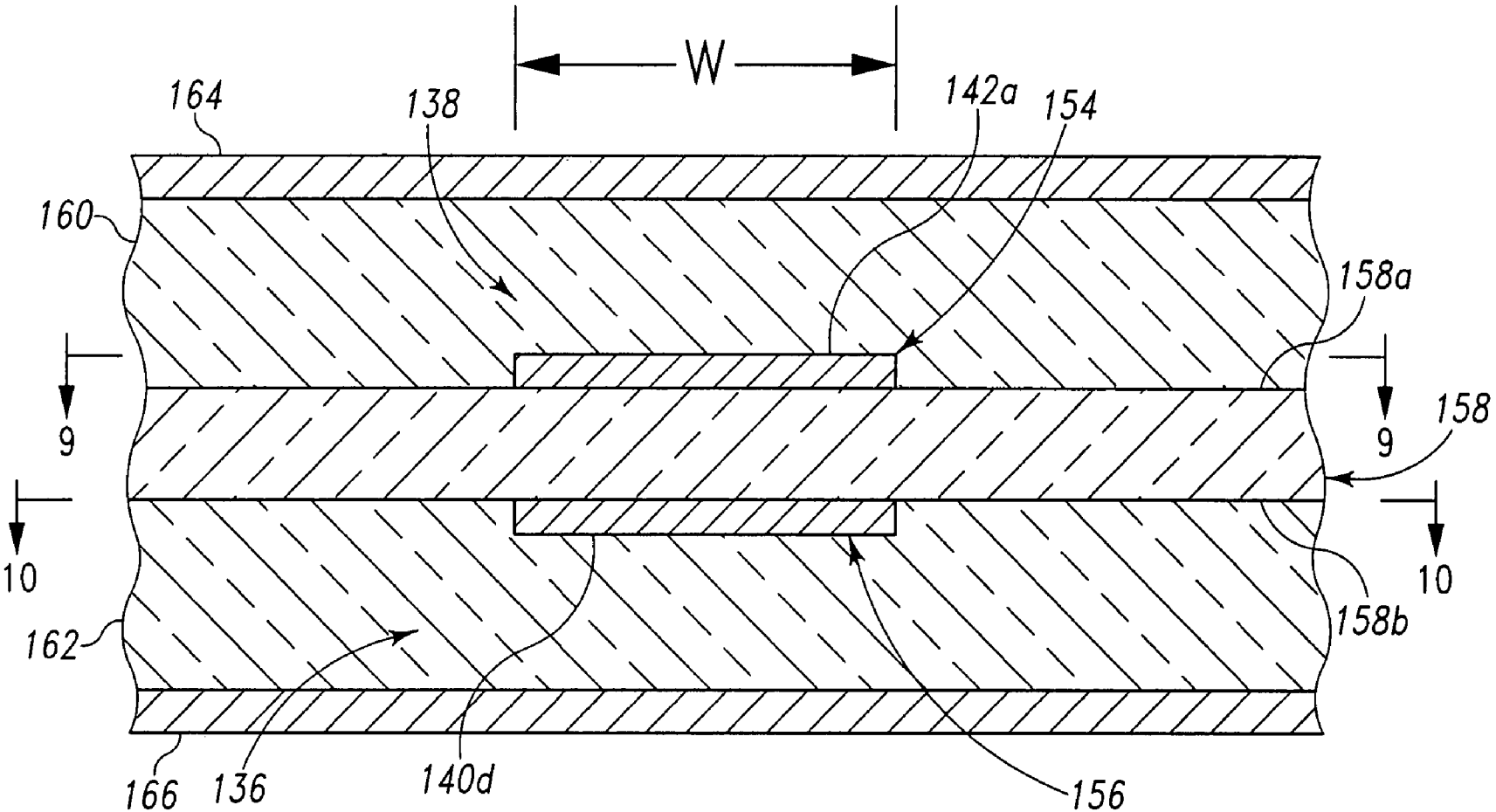
FIG. 8 is a cross-section taken along line 8—8 in FIG. 7.
Figure 9:
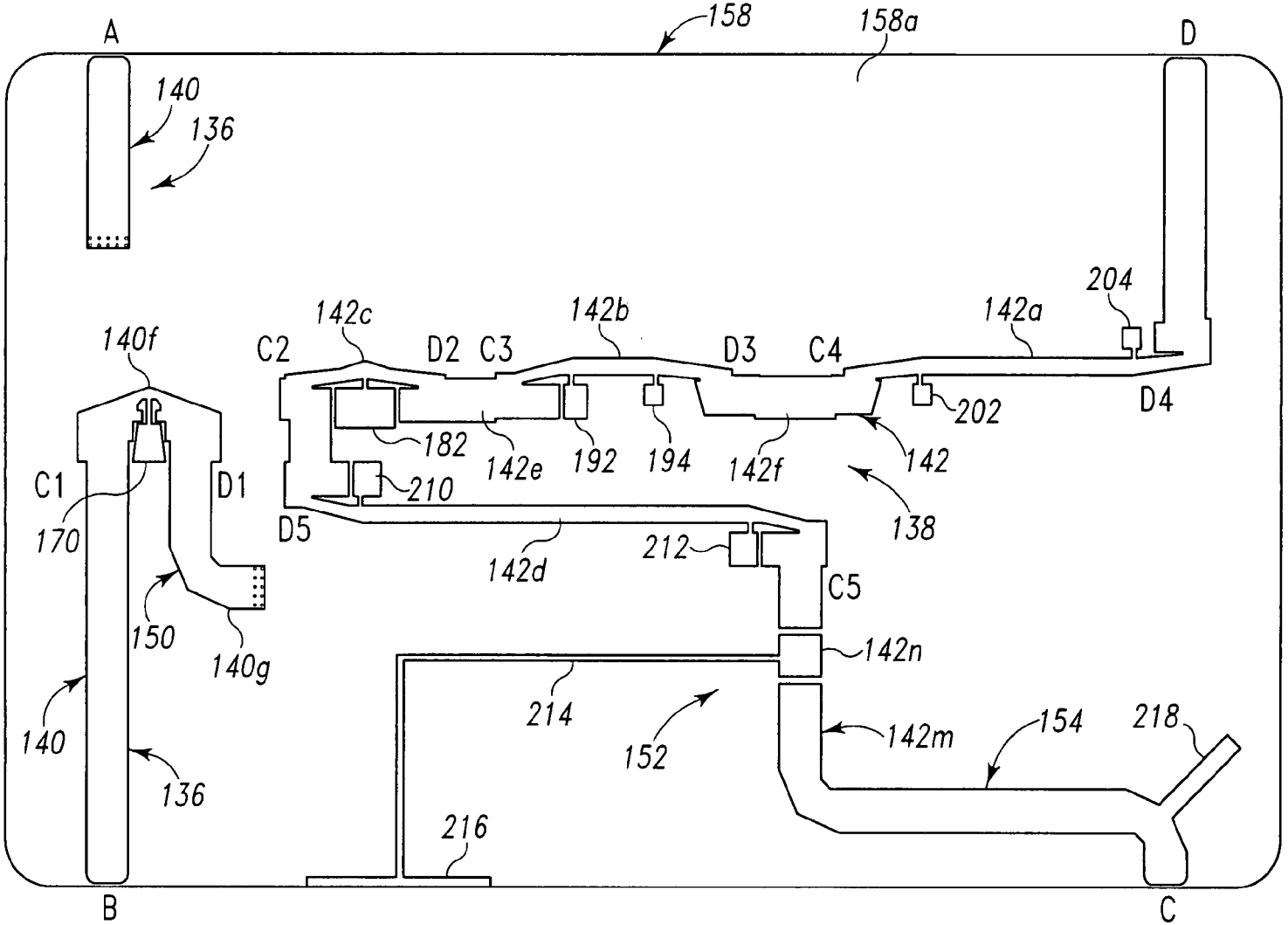
FIG. 9 is a plan view of one layer of metallization of the coupler assembly of FIG. 7.
Figure 10:
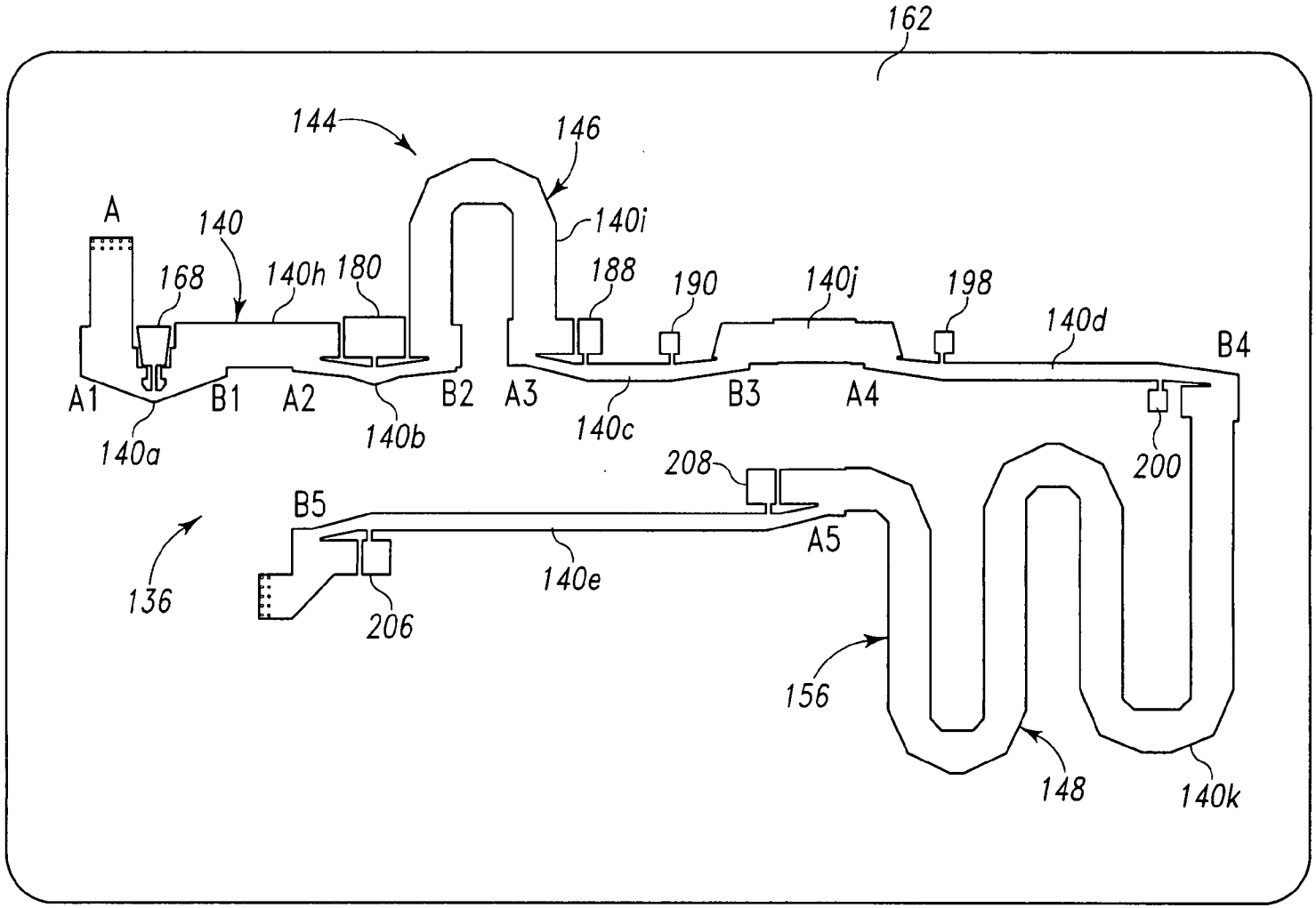
FIG. 10 is a plan view of the other layer of metallization of the coupler assembly of FIG. 7.

An example of such a coupler 120 is illustrated in FIGS. 7–10. In the specific example shown, there may be a 180-degree phase difference on signals output on ports B and C, and the power level of the signals on the output ports may be equal, making the coupler assembly a 180-degree hybrid coupler. Variations of the configuration may provide other forms of couplers. FIG. 7 is a plan view of coupler assembly 120 corresponding to the coupler assembly of FIG. 6. The reference numbers for coupler assembly 120 are used in FIGS. 7–10 for corresponding parts shown in FIG. 6. FIG. 8 is a cross section taken along line 8—8 of FIG. 7 showing an example of layers of a coupler assembly 120. FIG. 9 is a plan view of a first conductive layer 154 of coupler assembly 120, as viewed along line 9—9 in FIG. 8. FIG. 10 is a plan view of a second conductive layer 156, as viewed along line 10—10 in FIG. 8 at the transition between the conductive layer and a substrate between the two conductive layers. Coupler assembly 120 may be scaled for operation at selected frequencies. For example an operating frequency in the range of about 100 MHz to about 10 GHz may be realized, depending on manufacturing tolerances.

As shown in FIG. 8, coupler assembly 120 may include a first, center dielectric layer 158. Layer 158 may be a single layer or a combination of layers having the same or different dielectric constants. In one example, the center dielectric layer is less than 10 mils thick and is formed of a polyflon material, such as that referred to by the trademark TEFLON™. Optionally, the dielectric may be less than 10 mils thick, such as about 5 mils thick.

First conductive layer 154 may be positioned on a top surface 158*a* of the center dielectric layer 158, and second conductive layer 156 may be positioned on a lower surface 158*b* of the center dielectric layer. Optionally, the conductive layers may be self-supporting, or one or more supporting dielectric layers may be positioned above layer 154 and/or below layer 156.

A second dielectric layer 160 may be positioned above conductive layer 154, and a third dielectric layer 162 may be positioned below conductive layer 156, as shown. Dielectric layers 160 and 162 may be any suitable dielectric material or medium. In some examples, air may be all or a part of one or more of the dielectric layers described herein. In high power applications, heating in the narrow traces of the coupled sections may be significant. An alumina or other thermally conductive material may be used for dielectric substrates 160 and or 162 to support the conductive layer(s), and to act as a thermal shunt while adding capacitance.

A circuit ground or other reference potential may be provided on each side of the second and third dielectric layers by respective conductive layers 164 and 166. Layers 164 and 166 may contact dielectric layers 160 and 162, respectively.

Conductor 140 is formed primarily out of conductive layer 154, with ends of the conductor formed out of conductive layer 156. The two levels are interconnected by conductive vias 163 extending through dielectric layer 158. Conductor 140, forming port A, extends in conductive layer 154 from adjacent an edge of dielectric layer 158 through a first set of vias 163 to conductive layer 156 and to coupler 122. Conductor 140 forming port B extends in conductive layer 154 directly through coupler 122, along delay device 150 to a second set of vias to conductive layer 156. The remainder of conductor 140 is formed from conductive layer 156.

In coupler 122, coupled conductor portions 140*a* and 140*f* are broadside coupled, being disposed on opposite sides of the dielectric layer. Coupler 122 also includes peninsular tabs 168 and 170 with broad outer portions connected to the centers of the respective conductor portions 140*a* and 140*f* by a thin neck. The tabs extend in opposite directions relative to the coupled conductor portions. The outer portions couple capacitively to adjacent portions of conductor 140, as well as to the respective ground layers 164 and 166. Such a coupler is described in U.S. Patent Application Publication No. 2005/0122185 published Jun. 9, 2005, which publication is incorporated herein by reference. The cross-section of this coupled section, ignoring the peninsular tabs, is similar to the configuration shown in FIG. 8 for conductor portions 140*d* and 142*a*, but having a width less than width W shown in the figure.

Couplers and coupler sections 122, 128, 130, 132 and 134 form a series of coupled portions separated by uncoupled portions as described in U.S. Patent Application Publication No. 2004/0263281 published Dec. 30, 2004, which publication is incorporated herein by reference. A coupler that includes a coupled portion and an adjacent uncoupled portion, may have an effective electrical length equal to the sum of the electrical lengths of the two lines in the coupled section and the lengths of the lines in the uncoupled section. One or both of the coupled conductors may include a delay portion. The electrical length is defined as the line length divided by the wavelength of an operating frequency. In the case of a coupler in which only one line has a delay portion, the uncoupled section may have a length that equals the length of the space between the coupled sections (the length of the shorter uncoupled portion) plus the length of the delay portion. The delay portion in only one of the conductors in a coupler section makes the line lengths different for the two conductors, making the coupler section asymmetrical.

Thus, coupler 122 includes a coupled portion 172 formed by conductor portions 140*a* and 140*f*, as well as an uncoupled portion 174. Uncoupled portion 174 includes a conductor portion 140*g* forming delay device 150 in conductor 140, and a conductor portion 140*h*, which is not substantially coupled to conductor portion 140*g*. The conductor portions in coupled portion 172 are seen to be very short, so that coupler 122 is characterized as having a low coupling value.

Coupler 124 is comprised of couplers 126 and 128. Coupler 126 in turn is comprised of serially connected coupler sections 130, 132 and 134, as has been described with reference to FIG. 6. Coupler section 130 includes a coupled portion 176 and an uncoupled portion 178. Coupled portion 176 is comprised of coupled conductor portions 140*b* and 142*c* having a broadside coupled configuration as shown in FIG. 8, and a coupled length $L_1$. Uncoupled portion 178 includes a conductor portion 140*i* forming delay device 146, and a conductor portion 142*e*, which is not substantially coupled to a conductor portion 140*i*. Coupler section 130 also includes capacitive peninsular tabs 180 and 182 extending in opposite directions from the centers of the coupled conductor portions. These tabs have enlarged outer portions capacitively coupled to the respective conductor adjacent to each end of the coupled portion, as shown, as well as to the respective ground layers as discussed above.

Coupler section 132 includes a coupled portion 184 and an uncoupled portion 186. Coupled portion 184 is comprised of coupled conductor portions 140*c* and 142*b* having a broadside coupled configuration as shown in FIG. 8, and a coupled length $L_2$. Uncoupled portion 186 includes uncoupled conductor portions 140*j* and 142*f*. Coupler section 132 also includes capacitive peninsular tabs extending from the ends of the coupled conductor portions. Specifically, tabs 188 and 190 extend from the ends of conductor portion 140*c*, and tabs 192 and 194 extend from the ends of conductor portion 142*b*. As shown, the outer edge of each of tabs 188 and 192 are capacitively coupled to the respective conductor adjacent to each end of the coupled portion, as well as to the respective ground layers as discussed above.

Coupler section 134 includes a coupled portion 196, but no additional uncoupled portion. Coupled portion 196 is comprised of coupled conductor portions 140*d* and 142*a* having a broadside coupled configuration as shown in FIG. 8, and a coupled length $L_3$. Coupler section 132 also includes capacitive peninsular tabs extending in opposite directions from the ends of the coupled conductor portions. Specifically, tabs 198 and 200 extend from the ends of conductor portion 140*d*, and tabs 202 and 204 extend from the ends of conductor portion 142*a*.

It is seen that the lengths $L_1$, $L_2$, and $L_3$ increase in size progressively in coupler sections 130, 132 and 134. This change provides for a cascade configuration that makes coupler 126 an asymmetrical coupler. In other configurations, the sizes could be the same, be symmetrical, decrease in size progressively, or simply vary in size from one coupler section to the next. In each of these coupler sections, the configurations of the coupled conductor portions, may be the same, such as shown in FIG. 8. The coupling provided by each coupling section then may be determined by the length of the coupled portion. Longer coupled portions produce tighter coupling. In this example, it is seen that the electromagnetic coupling increases progressively from coupler section 130 to coupler section 134, and even coupler section 128. Correspondingly, it is seen that the capacitive tabs decrease in size progressively in coupler sections 130, 132 and 134. These tabs may be used to equalize the odd and even mode signal propagation, which modes are affected by the respective configurations of the associated couplers and coupler sections.

In the example shown, a conductor portion 140*k* forming delay device 148, and conductor portion 142*g* connect coupler 128 in tandem configuration to coupler 126, as has been explained. Delay device 148 contributes to the 180-degree phase change in the coupler assembly, and provides an appropriate amount of delay for coupler 128 to function well. Conductor portions 140*e* and 142*d* of coupler 128 may be broadside coupled and have a cross-section configuration as shown in FIG. 8. Coupled conductor portions 140*e* and 142*d* may have a length $L_4$. Delay device 150 connects port B5 to port D1 of coupler 122. A conductor portion 142*m* extends from the end of coupled conductor portion 142*d* to port C of coupler assembly 120.

Coupler 128 also includes capacitive peninsular tabs extending from the ends of the coupled conductor portions. Specifically, tabs 206 and 208 extend from the ends of conductor portion 140*e*, and tabs 210 and 212 extend from the ends of conductor portion 142*d*. As shown, the outer edge of each of these tabs are capacitively coupled to the respective conductor at each end of the associated coupled portion, as well as to the respective ground layers as discussed above.

In this example, phase shifter 152 includes an intermediate portion 142*n* of conductor portion 142*m* that is capacitively coupled to adjacent portions of the conductor portion. A thin conductor 214 extends from conductor portion 142*n* to a terminal 216, from which it can be connected to a reference potential, such as circuit ground. Conductor portion 142*n* provides in-line capacitance to conductor portion 142*m*, and conductor 214 provides inductance. The configuration of conductor portions 142*m* and 142*n* and conductor 214 produces a series-C, shunt-L, series C circuit that results in an appropriate phase shift in the signal at port C at the design operating frequencies to provide, in combination with the phase differential otherwise produced, a 180-degree phase difference between the signals on ports B and C of coupler assembly 120. The phase shifter may make the phase relatively constant over a given bandwidth of the coupler assembly, when it otherwise would be sloped. A further capacitive stub or tab 218 extends from the distal end of conductor portion 142*m*, near port C.

Each of the couplers or coupler sections described may be used separately as a coupler, or in other coupler assemblies. For example, coupler 126 also may be used separately as a multi-section 0–180-degree asymmetrical hybrid coupler. Also, coupler 124, formed as a combination of coupler 126 in tandem with coupler 128, may be used separately as a multi-section 0–180-degree asymmetrical hybrid coupler. The performance of coupler 124 may be enhanced compared to coupler 126. For example, the addition of coupler 128 may widen the operating bandwidth and reduce the ripple within the bandwidth. Further, the performance of coupler assembly 120 may be enhanced compared to coupler 124. Coupler 122 may provide additional loose coupling and delay that further increases the bandwidth and reduces the ripple.

As has been mentioned, while embodiments of coupler sections, couplers, coupler assemblies and methods of coupling signals have been particularly shown and described, many variations may be made therein.

INDUSTRIAL APPLICABILITY

The methods and apparatus described in the present disclosure are applicable to industries and systems using high frequency signals, such as used in telecommunications applications including audio, video and data communications, and broadcasting systems.

What is claimed is:

1. A coupler assembly comprising at least first and second electromagnetic couplers connected in cascade configuration, with at least the second coupler including at least third and fourth couplers connected in tandem configuration.

2. The coupler assembly of claim 1, in which at least one of the first, third and fourth couplers includes a plurality of coupler sections connected in cascade configuration.

3. The coupler assembly of claim 2, in which the one coupler is the third coupler.

4. The coupler assembly of claim 3, in which the third coupler is an asymmetric coupler.

5. The coupler assembly of claim 2, in which the coupler sections of the one coupler include at least a pair of electromagnetically coupled portions separated by an electromagnetically uncoupled portion.

6. The coupler assembly of claim 5, in which the coupled portions are formed by two conductors disposed in substantially the same cross-sectional configuration, the two conductors having electrical lengths that are progressively longer or shorter in successive coupled portions.

7. The coupler assembly of claim 6, in which the one coupler includes three coupler sections.

8. The coupler assembly of claim 1, in which the first coupler has an input port, and a coupled port electromagnetically coupled to the input port in the first coupler and conductively connected to the input port through the second coupler.

9. A coupler assembly comprising:

a first asymmetric electromagnetic coupler including a plurality of coupler sections connected in cascade configuration, the plurality of coupler sections including at least a pair of electromagnetically coupled portions separated by an electromagnetically uncoupled portion; and a second electromagnetic coupler connected to the first coupler in tandem configuration.

10. The coupler assembly of claim 9, in which the coupled portions are formed by two conductors configured in substantially the same cross-sectional configuration, the two conductors having electrical lengths that are progressively longer or shorter in successive coupled portions.

11. The coupler assembly of claim 10, in which the first coupler includes three coupler sections including coupled portions separated by uncoupled portions.

* * * * *